US009146009B2

(12) United States Patent
Zhu

(10) Patent No.: US 9,146,009 B2
(45) Date of Patent: Sep. 29, 2015

(54) MAGNETICALLY COUPLED SOLAR-POWERED LIGHTS

(71) Applicant: Shou Qiang Zhu, Ontario, CA (US)

(72) Inventor: Shou Qiang Zhu, Ontario, CA (US)

(73) Assignee: IP Power Holdings Limited (HK)

( * ) Notice: Subject to any disclaimer, the term of this patent is extended or adjusted under 35 U.S.C. 154(b) by 162 days.

(21) Appl. No.: 13/724,047

(22) Filed: Dec. 21, 2012

(65) Prior Publication Data

US 2014/0177211 A1 Jun. 26, 2014

(51) Int. Cl.

| | |
|---|---|
| ***A45B 3/04*** | (2006.01) |
| ***F21L 4/08*** | (2006.01) |
| *F21V 17/10* | (2006.01) |
| *F21Y 101/02* | (2006.01) |
| *F21S 9/03* | (2006.01) |

(52) U.S. Cl.

CPC .. *F21L 4/08* (2013.01); *F21S 9/032* (2013.01); *F21V 17/105* (2013.01); *F21Y 2101/02* (2013.01); *Y10T 29/49117* (2015.01)

(58) Field of Classification Search

USPC ..... 362/20, 102, 184, 191, 192, 194, 196, 362/249.01, 249.02, 249.05, 249.12, 398

See application file for complete search history.

(56) References Cited

U.S. PATENT DOCUMENTS

| | | | | |
|---|---|---|---|---|
| 2,654,022 | A * | 9/1953 | Batz et al. | 362/398 |
| 5,178,453 | A * | 1/1993 | Runels | 362/398 |
| 6,612,713 | B1 * | 9/2003 | Kuelbs | 362/102 |
| 6,820,995 | B2 * | 11/2004 | Lin | 362/102 |
| 7,000,624 | B2 * | 2/2006 | Chang | 135/16 |
| 7,134,762 | B2 * | 11/2006 | Ma | 362/102 |
| 7,431,469 | B2 * | 10/2008 | Li | 362/102 |
| 7,431,470 | B2 * | 10/2008 | Coleiro | 362/102 |
| 7,661,836 | B1 * | 2/2010 | Naranjo | 362/102 |
| 7,726,852 | B2 * | 6/2010 | Sanoner et al. | 362/398 |
| 8,317,355 | B1 * | 11/2012 | Wang | 362/183 |
| 2003/0000559 | A1 * | 1/2003 | Wu | 135/16 |
| 2004/0228118 | A1 * | 11/2004 | Peterson | 362/102 |

* cited by examiner

*Primary Examiner* — Ismael Negron

(74) *Attorney, Agent, or Firm* — Che-Yang Chen; Law Office of Michael Chen

(57) ABSTRACT

A solar lighting apparatus includes a controlling portion, having a first conjugating surface, a button with a plurality of lights, and electrodes hidden in the controlling portion; and an energy collecting portion, having a second conjugating surface, a solar panel to absorb sunlight, and corresponding receiving holes to receive the electrodes of the controlling portion, wherein a magnetic force is generated between the controlling portion and the energy collecting portion to tightly bind these two portions, and the electrodes are attracted out from the controlling portion by the magnetic force to plug into the receiving holes to form an energy conversion circuit to convert solar energy collected by the solar panel to other forms of energy.

10 Claims, 8 Drawing Sheets

MAGNETICALLY COUPLED SOLAR-POWERED LIGHTS

FIELD OF THE INVENTION

The present invention relates to solar-powered lights, and more particularly to a solar lighting system that is portable and can be secured at outdoor gears such as outdoor umbrellas and tents.

BACKGROUND OF THE INVENTION

Recently, solar energy becomes more and more popular to convert sunlight into other types of energy such as electricity and heat. Solar power is advantageous in situations where other power sources are unavailable because solar energy can be collected during the daytime via solar panels and the collected energy can be used to power other devices during the nighttime. In some situations, the solar cell can directly power a device, but it is more common to have the solar cell charged and maintain an energy storage device.

An LED (light-emitting diodes) lamp is a type of solid-state lighting that utilizes LEDs as a source of illumination. Recently, the use of LEDs for various lighting purposes has increased because LEDs have a very long lifespan (at least 100,000 hours), compared with common incandescent and fluorescent sources. Also, with newer doping techniques, LEDs are becoming increasingly efficient, and colored LED sources currently available may consume an order of magnitude less power than incandescent bulbs of equivalent light output. Because of these advantages, LEDs have been widely used in solar lighting devices in recent years.

Solar lighting devices can be disposed at some outdoor gears. U.S. Pat. No. 6,837,255 to Bunch et al. discloses an illuminated umbrella assembly having self-contained and protected lights. More specifically, Bunch et al. discloses an illuminated umbrella assembly that has a removable lighting protected from damage by being internally placed within the umbrella assembly. Also, the lighting is powered by solar panels disposed on the umbrella, as shown in FIG. 1. Even though the lighting fixture of the illuminated umbrella assembly is movable, the movement thereof is very limited because the solar panel is fixed on the umbrella assembly, and the connection and wiring between the solar panel and lighting fixture are fixed on the umbrella assembly. In other words, the lighting fixture and the solar panel are not portable and cannot be easily transferred to other outdoor gears such as other outdoor umbrellas or tents.

U.S. Pub. No. 2005/0254228 to Li discloses an outdoors umbrella which incorporates with a solar lighting system for providing illumination utilizing solar energy as an external energy source, as shown in FIG. 2. Thus, the solar lighting system is environmentally friendly and economical to operate. Also, the electrical operation of the solar light system is substantially unaffected by the folding and unfolding operation of the outdoors umbrella so that it is capable of fully operating while the outdoors umbrella is partially or inclinedly erected. However, the solar panels are fixed on the umbrella as well as the lighting fixtures, so the lighting fixture and the solar panel are not even portable and cannot be easily transferred to other outdoor gears such as tents.

U.S. Pat. No. 7,497,583 to Ma also discloses a light provider for an umbrella and stand assembly. More specifically, Ma discloses a portable, multi-purpose lighting device which can be easily fastened to, as well as un-fastened from, a pole-like object such as an umbrella stand, and without the trouble of having an electrical cord hanging undesirably from it. A plurality of solar panels are disposed near the post of the umbrella, as shown in FIG. 3. Even though Ma mentions that the lighting device is portable, the lighting fixtures along with the solar panels are too bulky to carry, let alone transferring them to other outdoor gears.

Therefore, there remains a need for a new and improved solar lighting system that is indeed portable, light weight, and easy to transfer to other outdoor gears to overcome the problems stated above.

SUMMARY OF THE INVENTION

It is an object of the present invention to provide a solar lighting system that is indeed portable, light weight, and easy to transfer to other outdoor gears such as outdoor umbrellas and tents.

It is another object of the present invention to provide a solar lighting system that can be divided into at least two portions, and these two portions can be tightly coupled with each other due to strong magnetic force therebetween.

It is a further object of the present invention to provide a solar lighting system that can be securely fixed at any fabric, wherein one portion of the solar lighting system is disposed at one side of the fabric, while the other portion is disposed at the other side of the fabric, and these two portions can be tightly coupled with each other due to strong magnetic force therebetween.

It is still a further object of the present invention to provide a solar lighting system in which the electrodes can be used to poke through the fabric to further secure the lighting system thereon.

In one aspect, a solar lighting apparatus may include a controlling portion and an energy collecting portion. The controlling portion has a button on top of the controlling portion and a switch located on one side thereof. A plurality of lights are arranged in the button and in one embodiment, these lights are LED lights. The energy collecting portion has a solar panel to absorb sunlight during the daytime at the bottom surface thereof, and the solar energy can be converted to charge the batteries to further power the lights.

In another embodiment, the solar lighting apparatus also has an alignment groove that may include a first groove and a second groove, located at the controlling portion and energy collecting portion respectively. In a further embodiment, a first magnetic may be embedded near the first conjugating surface of the controlling portion, while a second magnetic is embedded at the second conjugating surface of the energy collecting portion, and a strong magnetic force is thus generated to bring together the controlling and energy collecting portions. It is noted that the strongest magnetic force between the controlling and energy collecting portions may be generated when the first groove and the second groove are aligned to form the alignment groove to bring these two portions together. On the other hand, when the first groove and the second groove are not well-aligned, the magnetic force between the controlling portion and the energy collecting portion becomes much weaker, and these two portions cannot be properly coupled to form the solar lighting apparatus.

In a further embodiment, the solar lighting apparatus also includes a conducting portion, from which the solar energy collected from the solar panel can be converted to charge the batteries. The conducting portion may include a pair of electrodes and a pair of receiving holes having corresponding electrodes. When the controlling portion and the energy collecting portion are aligned and brought together within a predetermined distance, the electrodes that are initially hidden inside the controlling portion would be attracted out from the controlling portion by the magnetic force to plug into the receiving holes. Under such circumstances, an energy conversion circuit is formed, so the solar energy collected by the solar panel can be converted to charge the batteries through the conducting portion.

In still a further embodiment, if the connection between the electrodes and receiving holes are somewhat improper, the user can force the electrodes to plug into the receiving holes by pressing the button on the controlling portion. Likewise, once the energy conversion circuit is formed, the solar energy collected by the solar panel can be converted to charge the batteries through the conducting portion, and further power the lights.

In an exemplary embodiment, the solar lighting apparatus can be fixed on a piece of covering fabric of a tent, on which the energy collecting portion is disposed outside (the tent) to receiving sunlight during the daytime, while the controlling portion is disposed inside (the tent) to illuminate the tent during the nighttime. More particularly, the second conjugating surface would face an outer surface of the covering fabric, while the first conjugating surface would face an inner surface thereof, and the covering fabric would be disposed between the controlling portion and energy collecting portion when they are tightly coupled by the magnetic force therebetween. Furthermore, the electrode can poke through the covering fabric of the tent to further secure the solar lighting apparatus thereon. In other words, the solar lighting apparatus is actually clipped on the covering fabric of the tent. With this arrangement, the campers can leave the solar lighting apparatus on the tent during the daytime as long as they desire, and enjoy the illumination during the nighttime. The solar lighting apparatus can be fixed on other outdoor gears such as outdoor umbrellas.

In another aspect, a method for attaching a solar lighting system to an outdoor gear may include steps of separating the solar lighting system into two portions: a controlling portion and an energy collecting portion, wherein the controlling portion has a first conjugating surface and a button with a plurality of lights, while the energy collecting portion has a second conjugating surface and a solar panel; disposing the energy collecting portion on one side of a fabric material of the outdoor gear, wherein the solar panel of the energy collecting portion faces the sunlight, while the second conjugating surface thereof is facing the fabric material; disposing the controlling portion on the other side of the fabric material, wherein the first conjugating surface faces the second conjugating surface; and integrating the controlling portion and energy collecting portion to form the solar lighting system on the fabric material of the outdoor gear.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
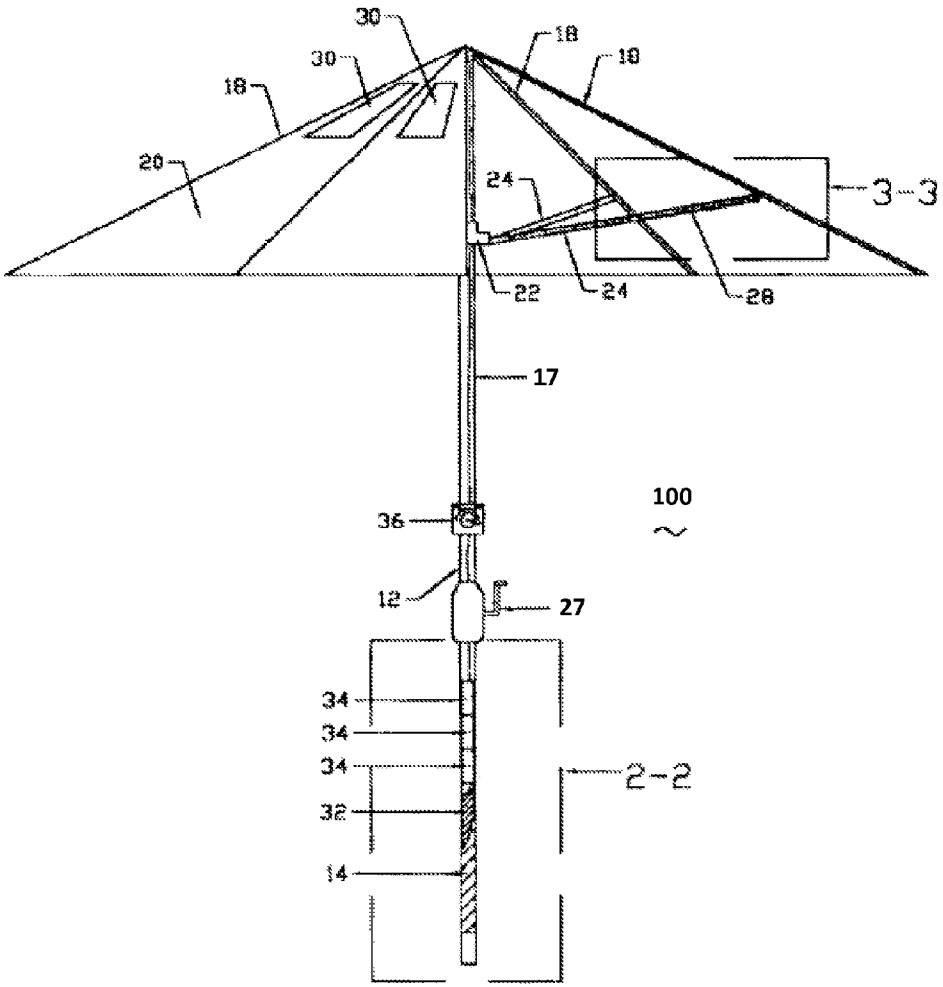
FIG. 1 (Prior art)
FIG. 1 is a prior art illustrating an illuminated umbrella assembly having self-contained and protected lights.
Figure 2:
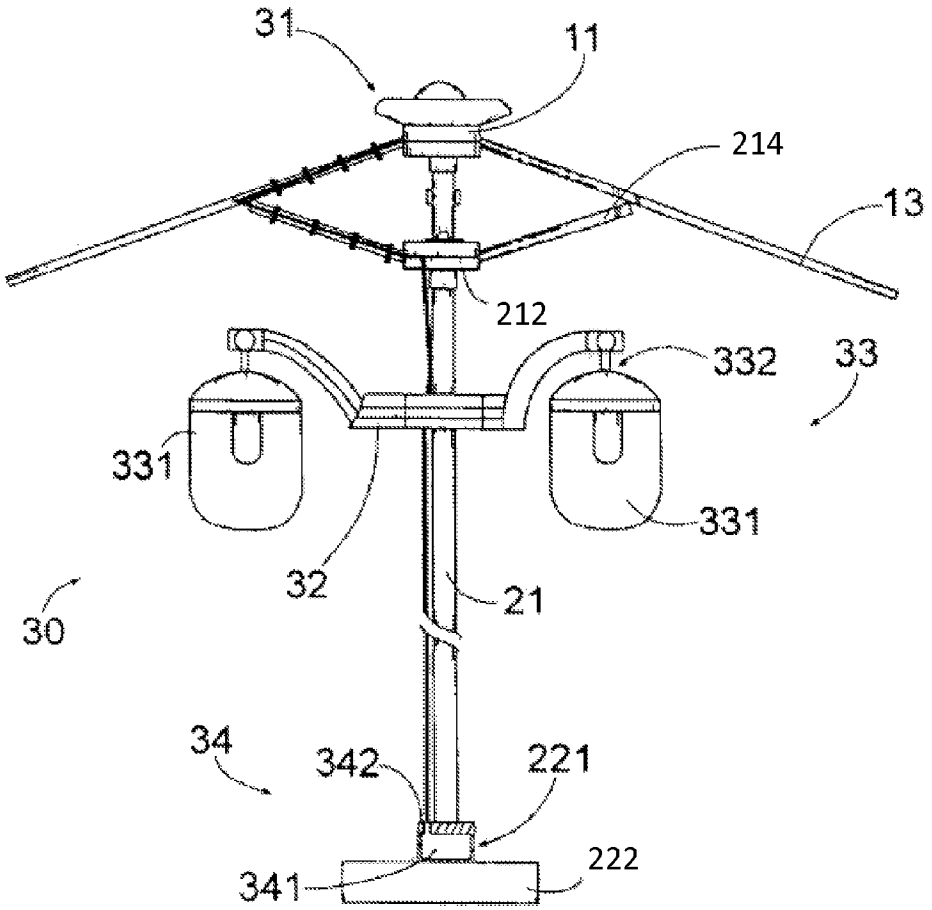
FIG. 2 (Prior art)
FIG. 2 is a prior art illustrating an outdoors umbrella which incorporates with a solar lighting system for providing illumination utilizing solar energy as an external energy source.
Figure 3:
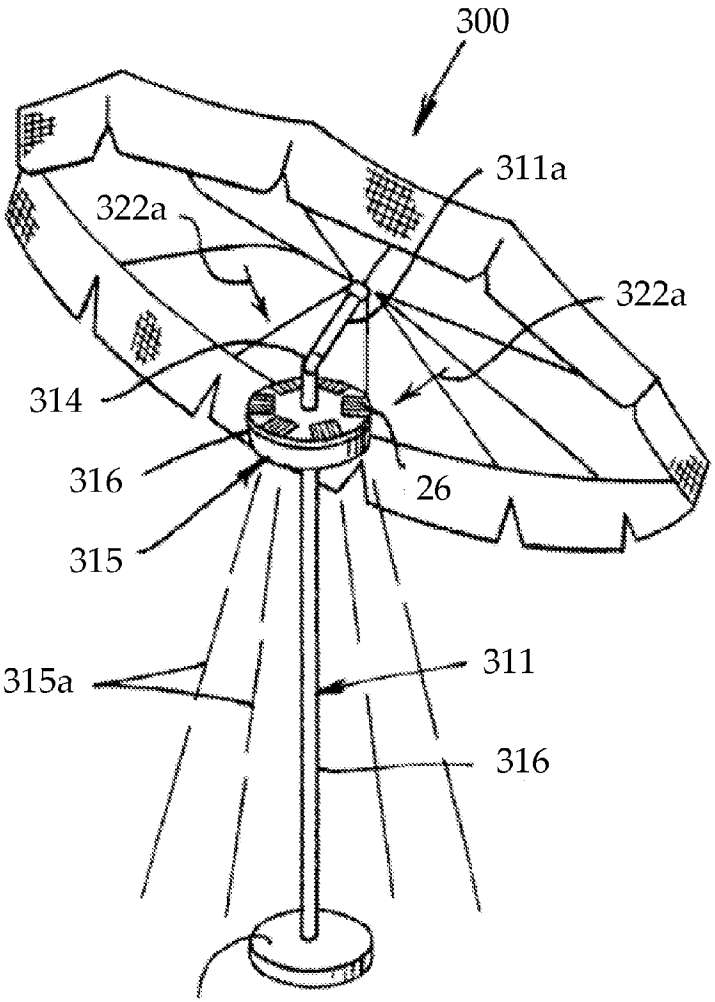
FIG. 3 (Prior art)
FIG. 3 is a prior art illustrating a light provider for an umbrella and stand assembly.
Figure 4:
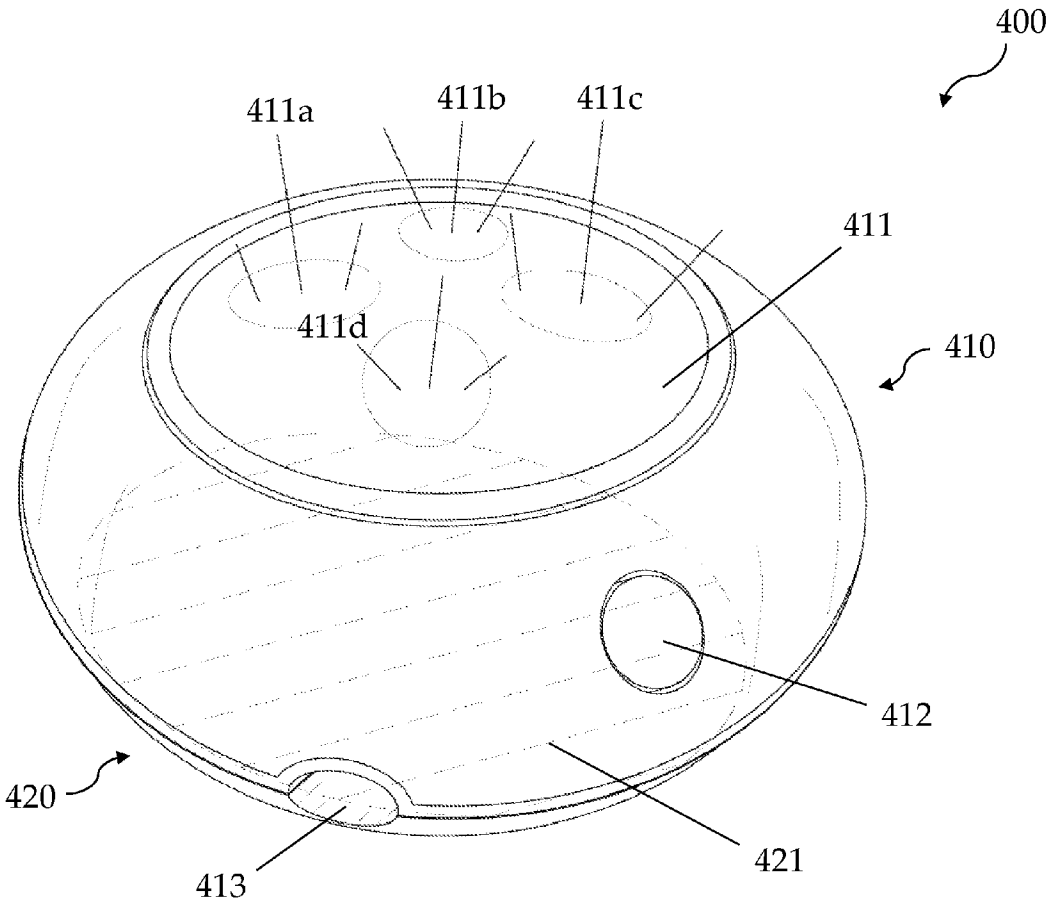
FIGS. 4, 4*a* to 4*c* illustrates a solar lighting apparatus disclosed in the present invention.

In order to further understand the goal, characteristics and effect of the present invention, a number of embodiments along with the drawings are illustrated as following:

Referring to FIG. 4, a solar lighting apparatus 400 may include a controlling portion 410 and an energy collecting portion 420. The appearance of the solar lighting apparatus 400 in the present invention resembles a smaller but thicker frisbee, which can be divided into a controlling portion 410 and an energy collecting portion 420 from nearly the center thereof. The controlling portion 410 has a button 411 on the top and a switch 412 located on one side thereof. A plurality of lights (411*a* to 411*d*) are arranged in the button 411 and in one embodiment, these lights are LED (light-emitting diode) lights, which have been widely used for various lighting purposes because of long lifespan and power efficiency. The energy collecting portion 420 has a solar panel 421 at the bottom surface thereof to absorb sunlight, and the solar energy can be converted to charge the batteries 414 disposed at the controlling portion 410 to further power the lights 411*a* to 411*d*.

Figure 4A:
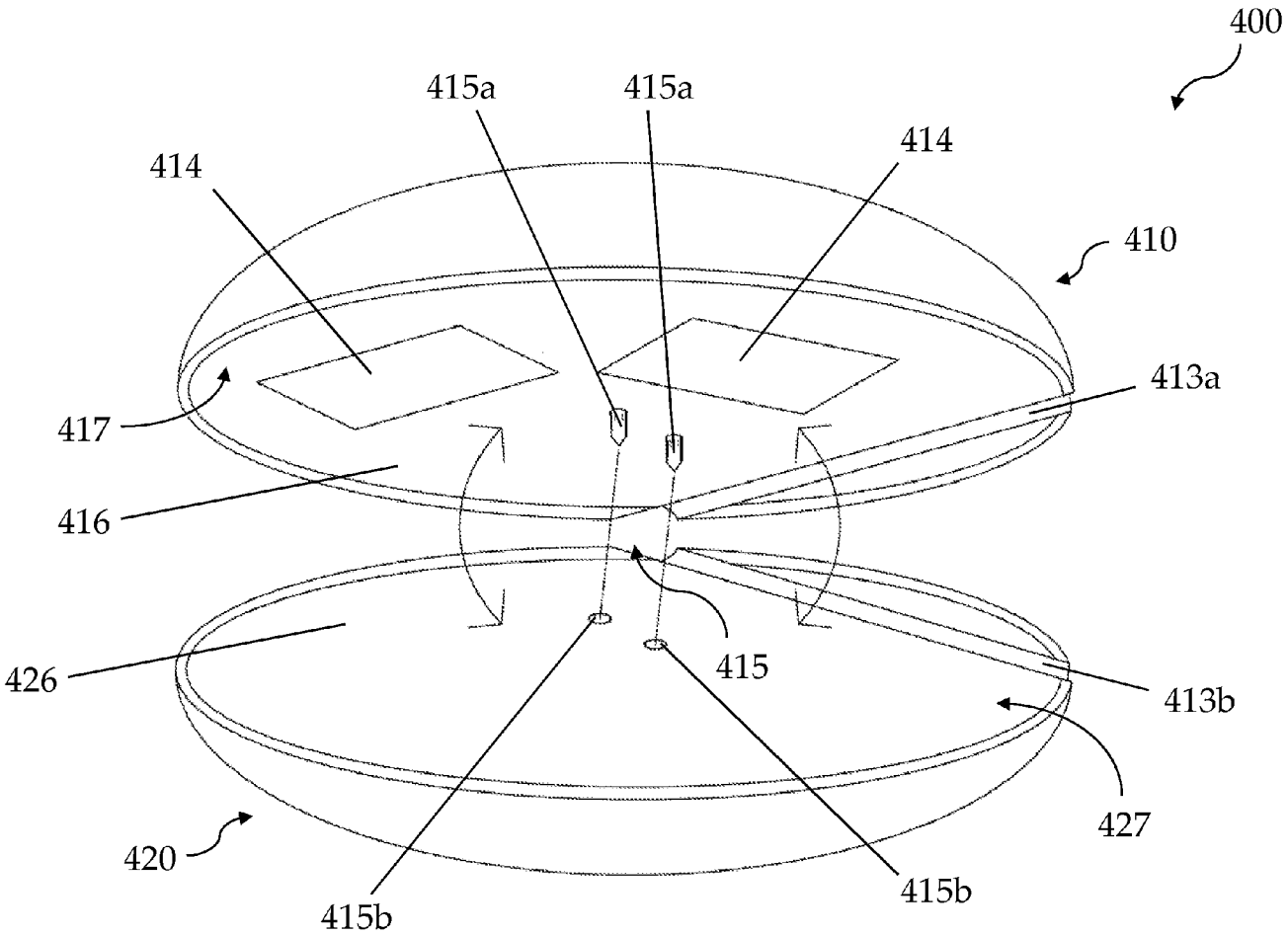
Figure 4B:
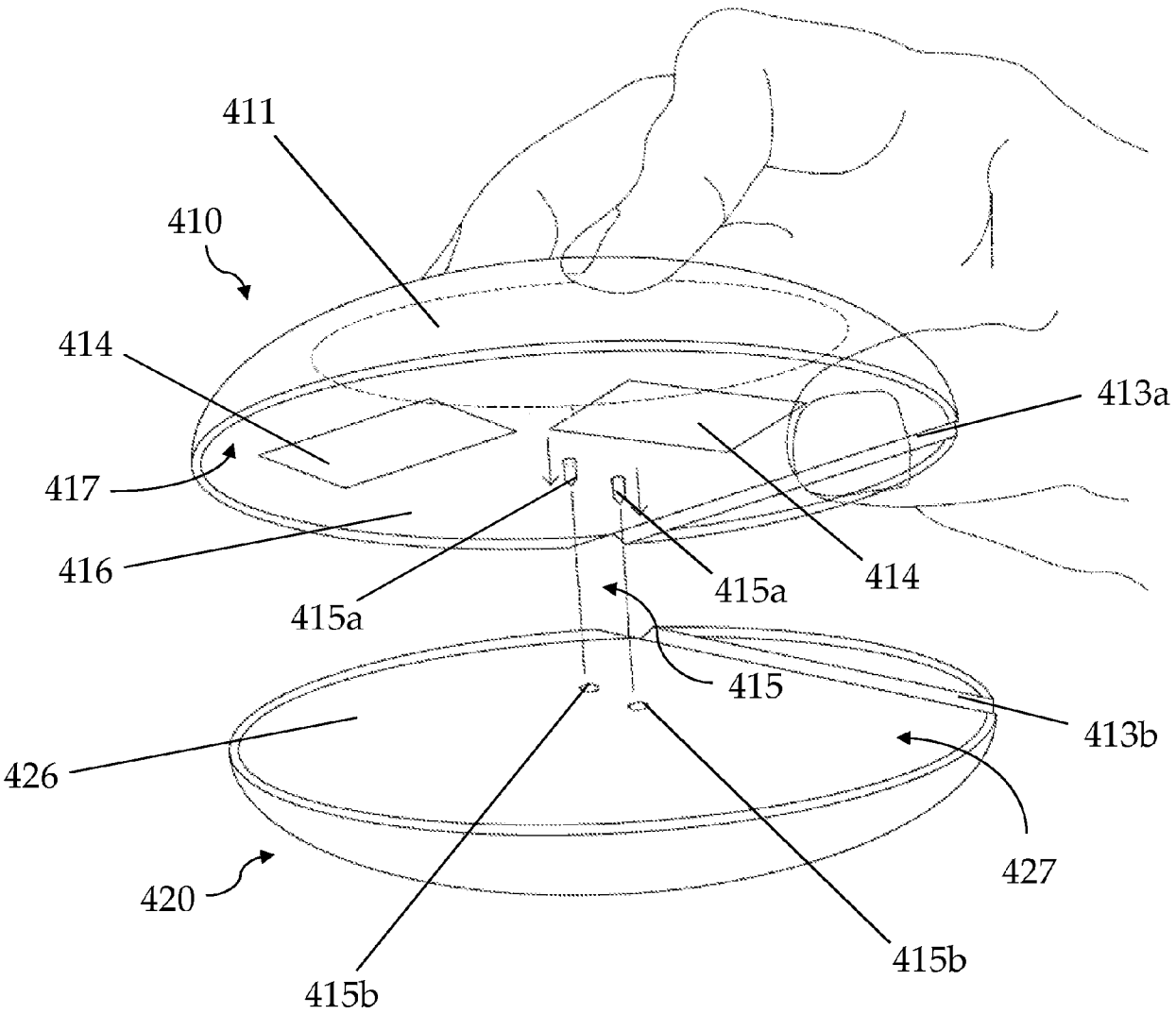

As shown in FIGS. 4 and 4*a*, the solar lighting apparatus 400 also has an alignment groove 413 that may include a first groove 413*a* and a second groove 413*b*, located at the controlling portion 410 and energy collecting portion 420 respectively. In the present invention, the controlling portion 410 and the energy collecting portion 420 are brought together by a strong magnetic force therebetween. More particularly, a first magnet 416 may be embedded near a first conjugating surface 417 of the controlling portion 410, while a second magnet 426 is embedded at a second conjugating surface of the energy collecting portion 420, as can be seen in FIGS. 4*a* and 4*b*. It is noted that the strongest magnetic force between the controlling and energy collecting portions (410, 420) may be generated when the first groove 413*a* and the second groove 413*b* are well-aligned to form the alignment groove 413 to tightly bind these two portions together. Also, the first conjugating surface 417 and the second conjugating surface 427 are substantially flat to create an almost seamless conjugation between the controlling and energy collecting portions (410, 420). On the other hand, when the first groove 413*a* and the second groove 413*b* are not well-aligned, the magnetic force between the controlling portion 410 and the energy collecting portion 420 becomes much weaker, and these two portions cannot be properly coupled to form the solar lighting apparatus 400 without proper alignment between the first and second grooves.

In an exemplary embodiment shown in FIG. 4*a*, the solar lighting apparatus 400 also includes a conducting portion 415, from which the solar energy collected from the solar panel 421 can be converted to charge the batteries 414 located at the controlling portion 410. The conducting portion 415 may include a pair of electrodes 415*a* and a pair of receiving holes 415*b* with corresponding electrodes. When the controlling portion 410 and the energy collecting portion 420 are aligned and brought together within a predetermined distance, the electrodes 415*a* that are initially hidden inside the controlling portion 410 would be attracted out from the controlling portion 410 by the magnetic force to plug into the receiving holes 415*b*. An energy conversion circuit may be formed under such circumstances, and the solar energy collected by the solar panel 421 can be converted to charge the batteries 414 through the conducting portion 415.

In another embodiment illustrated in FIG. 4*b*, if the connection between the electrodes 415*a* and receiving holes 415*b* is somewhat improper, the user can force the electrodes 415 to plug into the receiving holes 415*b* by pressing the button 411 on the controlling portion 410. Likewise, once the energy conversion circuit is formed, the solar energy collected by the solar panel 421 can be converted to charge the batteries 414 through the conducting portion 415, and further power the lights 411*a* to 411*d*.

Figure 4C:
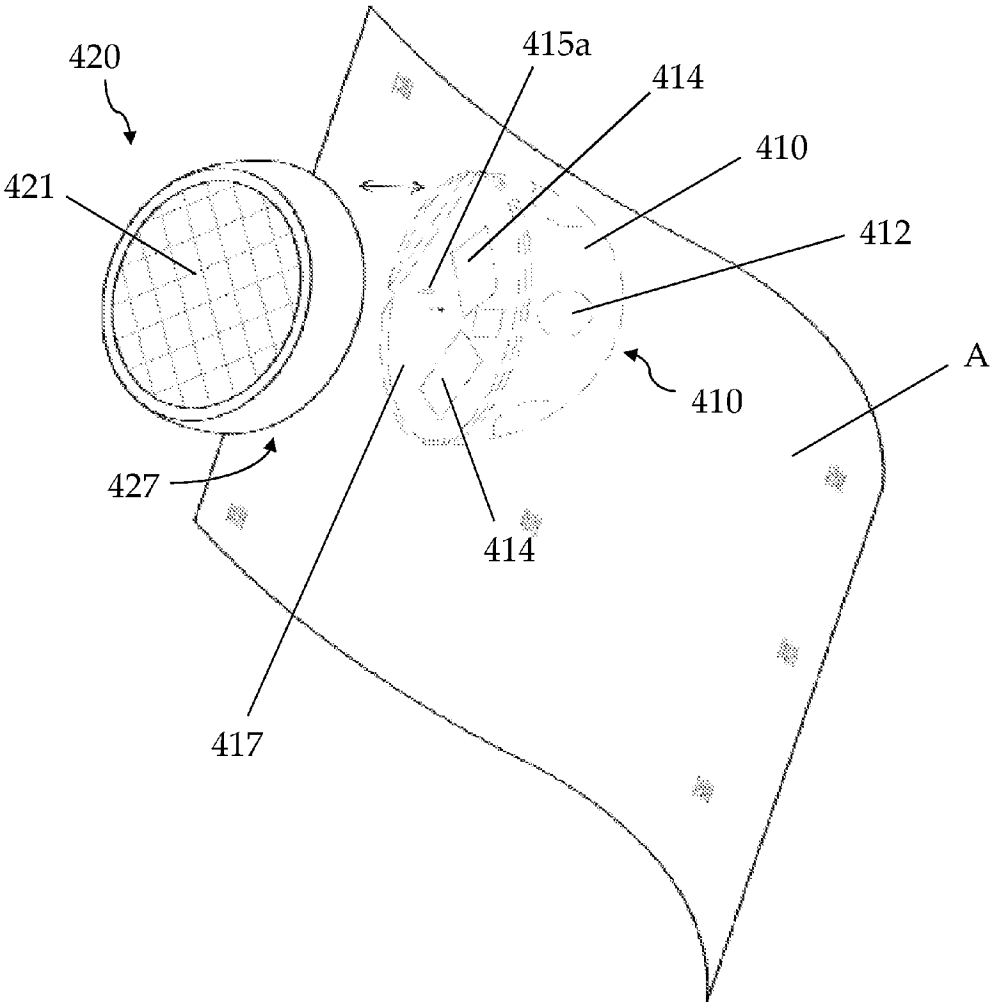
Figure 5:
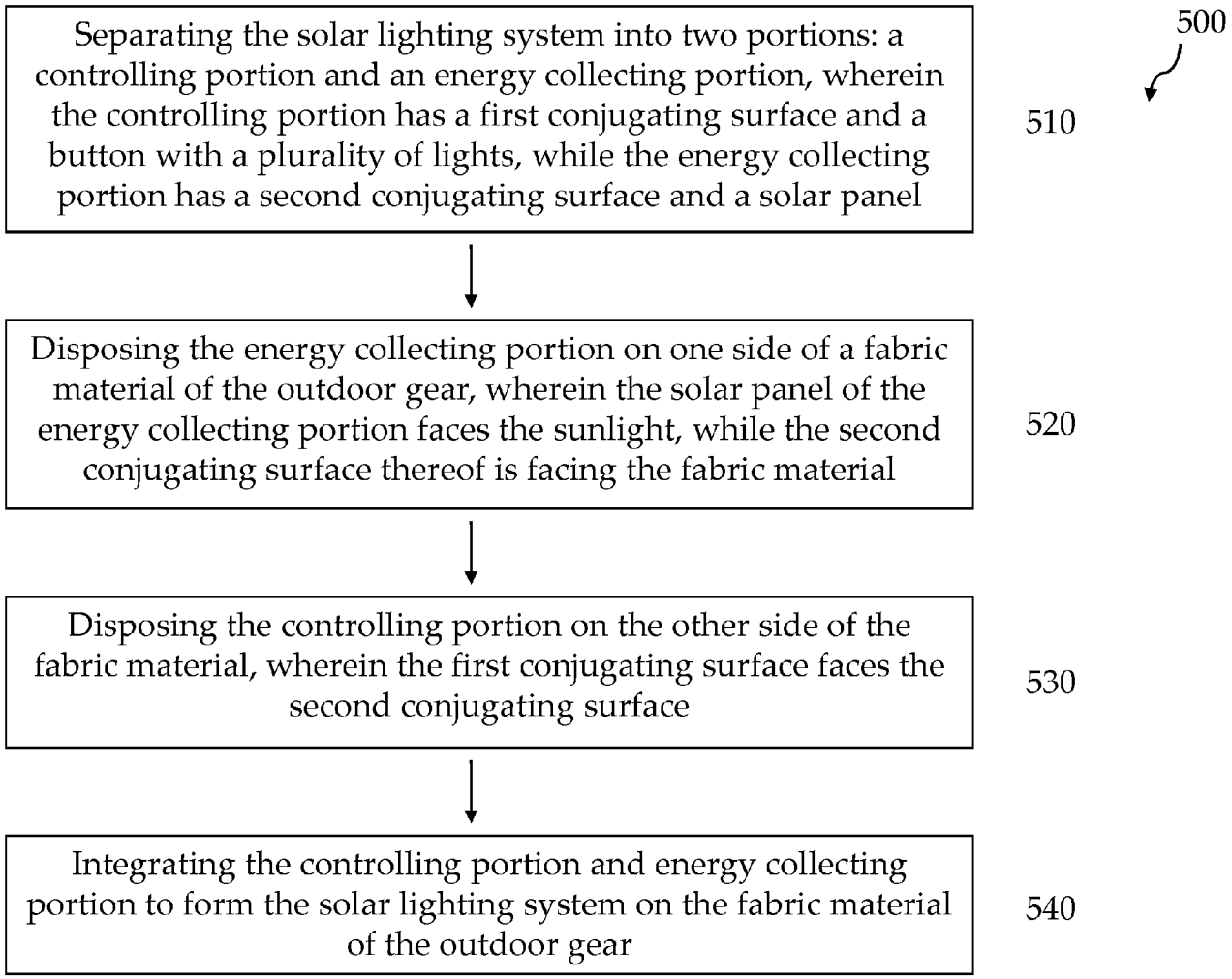
FIG. 5 illustrates a method for attaching a solar lighting system to an outdoor gear in the present invention.

In still an exemplary embodiment shown in FIG. 4*c*, when in use, the solar lighting apparatus 400 can be fixed on a substrate A by disposing the controlling portion 410 and energy collecting portion 420 on both sides of the substrate A. More specifically, as stated above, when these twp portions are aligned and brought together within a predetermined distance, the controlling and energy collecting portions (410, 420) would be tightly coupled by the magnetic force. Moreover, the electrodes 415*a* are made by metal with sharpened ends to poke through the substrate A and plug into the receiving holes 415*b* to further secure the solar lighting apparatus 400 on the substrate A. The substrate A can be any fabric material, as long as the electrodes 415*a* can poke through. For example, the solar lighting apparatus 400 can be fixed on a piece of covering fabric of a tent, on which the energy collecting portion 420 is disposed outside (the tent) to receiving sunlight during the daytime, while the controlling portion 410 is disposed inside (the tent) to illuminate the tent during the nighttime. More particularly, the second conjugating surface 427 would face an outer surface of the covering fabric, while the first conjugating surface 417 would face an inner surface thereof, and the covering fabric would be disposed between the controlling portion 410 and energy collecting portion 420 when they are tightly coupled by the magnetic force therebetween. Furthermore, the electrode 415*a* can poke through the covering fabric of the tent to further secure the solar lighting apparatus 400 thereon. In other words, the solar lighting apparatus is actually clipped on the covering fabric of the tent. With this arrangement, the campers can leave the solar lighting apparatus 400 on the tent during the daytime as long as they desire, and enjoy the illumination during the nighttime. The solar lighting apparatus 400 can be fixed on other outdoor gears such as outdoor umbrellas. The user can also manually press the button 410 to force the electrodes 415*a* to poke through the covering fabric.

In another aspect, a method for attaching a solar lighting system to a substrate 500 may include steps of separating the solar lighting system into two portions: a controlling portion and an energy collecting portion 510, wherein the controlling portion has a first conjugating surface, a button with a plurality of lights, and electrodes hidden therein, while the energy collecting portion has a second conjugating surface and a solar panel; disposing the energy collecting portion on one side of the substrate 520, wherein the solar panel of the energy collecting portion faces the sunlight, while the second conjugating surface thereof is facing the substrate; disposing the controlling portion on the other side of the substrate 530, wherein the first conjugating surface faces the second conjugating surface; and integrating the controlling portion and energy collecting portion to form the solar lighting system on the substrate 540.

In one embodiment, the step of integrating the controlling portion and energy collecting portion to form the solar lighting system 540 may include steps of utilizing magnetic force generated between the controlling portion and energy collecting portion to tightly bind these two portions 541; and arranging the electrodes on the controlling portion to poke through the substrate to clip the solar system thereon 542. In an exemplary embodiment, the substrate is a covering fabric of an outdoor gear including a tent, an outdoor umbrella or the like.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A solar lighting apparatus comprising:

a control portion, having a first conjugating surface, a button with a plurality of lights, and electrodes hidden in the control portion;

an energy collecting portion, having a second conjugating surface, a solar panel to absorb sunlight, and corresponding receiving holes to receive the electrodes of the control portion; and an alignment groove having a first groove on the control portion and a second groove on the energy collecting portion, the first groove extending linearly on the first conjugating surface from one point on the periphery of the control portion to a second point on the periphery of the control portion, and the second groove extending linearly on the second conjugating surface from one point on the periphery of the energy collecting portion to a second point on the periphery of the energy collecting portion;

wherein a magnetic force, not used for magnetic induction to transmit electrical power, is generated between the control portion and the energy collecting portion to tightly bind these two portions, and the electrodes are attracted out from the control portion by said magnetic force to plug into the receiving holes to form an energy conversion circuit to convert solar energy collected by the solar panel to other forms of energy, wherein the strongest magnetic force to bind the control portion and the energy collecting portion is generated when the first groove and the second groove are aligned to form the alignment groove.

2. The solar lighting apparatus of claim 1, wherein the lights in the button of the control portion are LED (Light Emitting Diode) lights.

3. The solar lighting apparatus of claim 1, wherein said magnetic force is generated by a first magnet is embedded near the first conjugating surface, and a second magnet is embedded near the second conjugating surface.

4. The solar lighting apparatus of claim 1, wherein the control portion further comprises batteries to power the lights, and the batteries are charged when the energy conversion circuit is formed.

5. The solar lighting apparatus of claim 1, wherein the control portion and the energy collecting portion are configured to be disposed on both sides of a substrate, said solar panel facing the sunlight while the second conjugating surface faces the substrate on one side, and said first conjugating surface facing the substrate on the other side; and wherein the control portion and the energy collecting portion are tightly coupled with the substrate in between.

6. The solar lighting apparatus of claim 5, wherein the electrodes are used to poke through the substrate and plug into the receiving holes of the energy collecting portion to further secure the control portion and the energy collecting portion on the substrate.

7. The solar lighting apparatus of claim 6, wherein the substrate is a covering fabric of a tent, or an outdoor umbrella.

8. The solar lighting apparatus of claim 6, wherein the electrodes are configured to poke through the substrate if the button of the control portion is pressed.

9. A method for attaching a solar lighting system to a substrate comprising steps of:

separating the solar lighting system into two portions: a control portion and an energy collecting portion, wherein the control portion has a first conjugating surface, a button with a plurality of lights, and electrodes hidden therein, while the energy collecting portion has a second conjugating surface and a solar panel;

providing an alignment groove having a first groove on the control portion and a second groove on the energy collecting portion, wherein the first groove extends linearly on the first conjugating surface from one point on the periphery of the control portion to a second point on the periphery of the control portion, and the second groove extends linearly on the second conjugating surface from one point on the periphery of the energy collecting portion to a second point on the periphery of the energy collecting portion;

disposing the energy collecting portion on one side of said substrate, wherein the solar panel of the energy collecting portion faces the sunlight, while the second conjugating surface thereof is facing one side of the substrate;

disposing the control portion on the other side of the substrate, wherein the first conjugating surface faces the second conjugating surface;

utilizing a magnetic force generated between the control portion and energy collecting portion to tightly bind these two portions; and arranging the electrodes on the control portion to poke through the substrate to clip the solar system thereon, wherein the magnetic force is not used for magnetic induction to transmit electrical power, wherein the strongest magnetic force to bind the control portion and the energy collecting portion is generated when the first groove and the second groove are aligned to form the alignment groove.

10. The method for attaching a solar lighting system to substrate of claim 9, wherein the substrate is a covering fabric of a tent, or an outdoor umbrella.

* * * * *